US009631622B2

(12) United States Patent
Kilkenny

(10) Patent No.: US 9,631,622 B2
(45) **Date of Patent: *Apr. 25, 2017**

(54) INDUCER FOR CENTRIFUGAL PUMP

(71) Applicant: Ebara International Corporation, Sparks, NV (US)

(72) Inventor: Everett Russell Kilkenny, Sparks, NV (US)

(73) Assignee: Ebara International Corporation, Sparks, NV (US)

( * ) Notice: Subject to any disclaimer, the term of this patent is extended or adjusted under 35 U.S.C. 154(b) by 722 days.

This patent is subject to a terminal disclaimer.

(21) Appl. No.: 13/961,699

(22) Filed: Aug. 7, 2013

(65) Prior Publication Data

US 2015/0044026 A1 Feb. 12, 2015

Related U.S. Application Data

(62) Division of application No. 12/903,128, filed on Oct. 12, 2010, now Pat. No. 8,550,771.

(60) Provisional application No. 61/278,666, filed on Oct. 9, 2009.

(51) Int. Cl.

| | |
|---|---|
| ***F04D 1/06*** | (2006.01) |
| ***F04D 7/02*** | (2006.01) |
| ***F04D 29/22*** | (2006.01) |
| ***F04D 29/44*** | (2006.01) |

(52) U.S. Cl.

CPC ..... *F04D 7/02* (2013.01); *F04D 29/2277* (2013.01); *F04D 29/445* (2013.01)

(58) Field of Classification Search

CPC ..... F04D 3/02; F04D 7/04; F03B 3/12; F03D 3/02

See application file for complete search history.

(56) References Cited

U.S. PATENT DOCUMENTS

| | | | |
|---|---|---|---|
| 1,490,955 | A | 4/1924 | Bell et al. |
| 1,839,126 | A | 12/1931 | Sperry |
| 3,198,423 | A | 8/1965 | Clute |

(Continued)

OTHER PUBLICATIONS

B. Lakshminarayana, Fluid Dynamic of Inducers—A Review, Transactions of the ASME Journal of Fluids Engineering, Dec. 1982, vol. 104, pp. 411-427.

(Continued)

*Primary Examiner* — Mark Laurenzi
*Assistant Examiner* — Shafiq Mian
(74) *Attorney, Agent, or Firm* — Ray K. Shahani; Kin Hung Lai

(57) ABSTRACT

An inducer for vertical flow, cryogenic liquid centrifugal pumps comprising a stationary outer housing portion having an inlet and an outlet, the inlet located at a lower end and the outlet located at an upper end, the housing further having an inner wall portion with one or more spiral vanes projecting outwardly from the inner wall portion, the one or more spiral vanes defining one or more gap regions on the inner wall portion that spiral in a first direction, and an inner rotating impeller mounted on a rotating center shaft, the impeller having at least one curved blade which defines a curved, helicoid plane surface in which the slope of the plane increases as the distance from the center axis increases, the impeller rotating in a second direction which is in counter rotation to the first direction.

8 Claims, 18 Drawing Sheets

(56) References Cited

U.S. PATENT DOCUMENTS

| | | | | |
|---|---|---|---|---|
| 3,442,220 | A | 5/1969 | Mottram et al. | |
| 3,644,056 | A | 2/1972 | Wiselius | |
| 3,737,249 | A | 6/1973 | Cooper | |
| 4,019,829 | A | 4/1977 | Knopfel et al. | |
| 4,540,344 | A | 9/1985 | Stahle | |
| 4,648,796 | A | 3/1987 | Maghenzani | |
| 4,789,299 | A | 12/1988 | Memetrius et al. | |
| 5,487,644 | A | 1/1996 | Ishigaki et al. | |
| 5,505,594 | A | 4/1996 | Sheehan | |
| 6,116,338 | A | 9/2000 | Morrison et al. | |
| 6,220,816 | B1 | 4/2001 | Nguyen Duc et al. | |
| 6,343,909 | B1 | 2/2002 | Springer et al. | |
| 6,361,939 | B1 | 3/2002 | Bosley | |
| 6,474,939 | B1 * | 11/2002 | Bratu | F04D 31/00 415/143 |
| 7,021,890 | B2 | 4/2006 | Ishigaki et al. | |
| 7,207,767 | B2 | 4/2007 | Ashihara et al. | |
| 7,455,497 | B2 | 11/2008 | Lee | |
| 8,550,771 | B2 | 10/2013 | Kilkenny | |
| 2006/0263201 | A1 | 11/2006 | Harman | |
| 2007/0172345 | A1 * | 7/2007 | Stahle | F04D 7/04 415/71 |
| 2007/0248454 | A1 * | 10/2007 | Davis | F04D 3/00 415/74 |

OTHER PUBLICATIONS

Helicoid, http://en.wikipedia.org/wiki/Helicoid.

* cited by examiner

INDUCER FOR CENTRIFUGAL PUMP

RELATED APPLICATIONS

This application is a Divisional Patent Application of U.S. patent application Ser. No. 12/903,128 filed Oct. 12, 2010 entitled "INDUCER FOR CENTRIFUGAL PUMP", which is a Nonprovisional Patent Application of U.S. Provisional Patent Application Ser. No. 61/278,666 filed Oct. 9, 2009 entitled "INDUCER FOR CENTRIFUGAL PUMP", which is incorporated herein by reference in its entirety, and claims any and all benefits to which it is entitled therefrom.

FIELD OF THE INVENTION

The present invention pertains to a noncavitating inducer for cryogenic centrifugal pump, and more specifically, to a unique inducer blade/vane design and configuration and inducer system for enhancing centrifugal pump efficiency and decreasing the net positive suction head required (NPSHR) for proper pump operation.

BACKGROUND OF THE INVENTION

FIG. 1A (prior art) is a representative view showing a partial plot of the helicoid plane known heretofore.

FIG. 1B (prior art) is a representative view of an inducer for centrifugal pumps having helicoid planar surfaces currently in use. As best shown in FIG. 1B, helicoid planar surfaces are commonly found in inducer blade configuration for centrifugal pump.

An inducer is an axial flow impeller with blades that wrap in a helix around a central hub or shaft. Inducers are commonly used in cryogenic systems, including storage tanks, rocket fuel pump feed systems, and other similar uses. Inducers are used in such systems to prevent the fluid being moved from cavitating in the impeller or pump, which can occur when there is not enough pressure to keep the liquid from vaporizing, at least in part. Noncavitating inducers are used to pressurize the flow of the input fluid sufficient to enable the devices to which the inducer is attached to operate efficiently. An excellent discussion of the fluid dynamic properties of inducers is provided by B. Lakshminarayana, Fluid Dynamics of Inducers—A Review, Transactions of the ASME Journal of Fluids Engineering, December 1982, Vol. 104, Pages 411-427, which is incorporated herein by reference.

In theory, the helicoid, derived from the plane and the catenoid, is the third minimal surface to be known. It was first discovered by Jean Baptiste Meusnier in 1776. Its name derives from its similarity to the helix: for every point on the helicoid there is a helix contained in the helicoid which passes through that point. Since it is considered that the planar range extends through negative and positive infinity, close observation shows the appearance of two parallel or mirror planes in the sense that if the slope of one plane is traced, the co-plane can be seen to be bypassed or skipped, though in actuality the co-plane is also traced from the opposite perspective.

The helicoid is also a ruled surface (and a right conoid), meaning that it is a trace of a line. Alternatively, for any point on the surface, there is a line on the surface passing through it. Indeed, Catalan proved in 1842 that the helicoid and the plane were the only ruled minimal surfaces.

The helicoid and the catenoid are parts of a family of helicoid-catenoid minimal surfaces.

The helicoid is shaped like Archimedes' screw, but extends infinitely in all directions. It can be described by the following parametric equations in Cartesian coordinates:

$$x=\rho\cos(\alpha\theta),$$

$$y=\rho\sin(\alpha\theta),$$

$$z=\theta,$$

where $\rho$ and $\theta$ range from negative infinity to positive infinity, while $\alpha$ is a constant. If $\alpha$ is positive then the helicoid is right-handed as shown in the figure; if negative then left-handed.

The helicoid has principal curvatures $\pm 1/(1+\rho^2)$. The sum of these quantities gives the mean curvature (zero since the helicoid is a minimal surface) and the product gives the Gaussian curvature.

The helicoid is homeomorphic to the $\mathbb{R}^2$. To see this, let alpha decrease continuously from its given value down to zero. Each intermediate value of a will describe a different helicoid, until $\alpha=0$ is reached and the helicoid becomes a vertical plane.

Conversely, a plane can be turned into a helicoid by choosing a line, or axis, on the plane then twisting the plane around that axis.

FIG. 1C (prior art) is a representative view showing a partial plot of the helicoid plane surface of the inducer rotor currently in use.

FIG. 1D (prior art) is a representative view showing another partial plot of the helicoid plane surface and vertical bisecting plane of the inducer rotor currently in use.

FIG. 1E (prior art) is a representative view showing an axial water jet pump 60 such as used for propulsion of a high-speed boat currently in use. As best shown in FIG. 1E, the inducer blades 61 rotate around the shaft 63 in direction A as they sweep through the water. The back side 62 of the blade pushes against the water, trying to accelerate it within the inducer passage, as the front side 64 of the blade experiences a localized reduction in pressure. As a result, water enters the inducer from the inlet 66 and gains rotational momentum while being pushed along the length of the inducer and eventually propelled out of the inducer at the outlet 68 in much higher speed after going through a stator 69 with counter-rotational blades which reduces the rotational momentum of the water, if any, and directs the water directly out the end 68 in direction B.

A common problem with spiral or helical inducers used within centrifugal pumps and similar devices is that the fluid in the tank in which the centrifugal pump is installed will begin to rotate in the same direction as, and along with, the inducer blades. When this occurs, the fluid does not move up through the inducer as efficiently. This phenomenon can also result in a change in pressure near the inlet of the inducer and increase the amount of net positive suction head required [NPSHR] to make the pump continue to work efficiently or properly.

When the pressure of a liquid, such as a cryogenic fluid, falls below the vapor pressure, vapor bubbles will form in the fluid. As this liquid-vapor fluid combination is pumped through a machine, such as an inducer, impeller or pump, the fluid pressure increases. If the fluid pressure increases above the vapor pressure, the vapor bubbles in the fluid will collapse, which is called "cavitation." It is desirable to prevent cavitation in devices because the collapsing bubbles can generate shock waves that are strong enough to damage moving parts around them. In addition, cavitation causes noise, vibration, and erosion of material from the device. Thus, the service life of a pump can be shortened due to cavitation.

However, it is desirable, when pumping cryogenic fluid from a tank to get the fluid pressure as close to the vapor pressure as possible, in order to pump more fluid from the tank. In other words, it is desirable for the net positive suction head available (NPSHA) in the tank to be greater than the net positive suction head required (NPSHR) of the pump. NPSHA is a function of the system in which the pump operates, such as the pressure of the fluid within a containment vessel or tank before it enters the inducer at the inlet of the pump, and the liquid depth of the vessel or tank housing the pump, among other factors.

The techniques used to improve pump performance relative to the operation of inducers vary significantly. For example, Nguyen Duc et al., U.S. Pat. No. 6,220,816, issued Apr. 24, 2001, describes a device for transferring fluid between two different stages of a centrifugal pump through use of a stator assembly that slows down fluid leaving one impeller before entering a second impeller. A different technique is used in Morrison et al., U.S. Pat. No. 6,116,338, issued Sep. 12, 2000, which discloses a design for an inducer that is used to push highly viscous fluids into a centrifugal pump. In Morrison et al., an attempt is made to resolve the problem of fluids rotating with the inducer blades by creating a very tight clearance between the blades of the auger of the inducer and the inducer housing, and configuring the auger blades in such a way as to increase pressure as fluid moves through the device to the pump.

While grooves have been used in inducer designs in the past, they have not been used to help efficiently move the fluid through the inducer. For example, in Knopfel et al., U.S. Pat. No. 4,019,829, issued Apr. 26, 1977, an inducer is illustrated that has a circumferential groove around a hub at the front of the inducer. This design causes turbulence to develop within the grooves of the inducer hub rather than in the fluid outside of the grooves, thereby reducing the tendency of the fluid to pulsate and generate noise.

Grooves are also illustrated and described in Okamura et al., An Improvement of Performance-Curve Instability in a Mixed-Flow Pump by J-Grooves, Proceedings of 2001 ASME Fluids Engineering Division, Summer meeting (FEDSM '01), May 29-Jun. 1, 2001, New Orleans, La. In Okamura et al., a series of annular grooves are formed on the inner casing wall of a mixed-flow water pump to suppress inlet flow swirl and therefore passively control the stability performance of the pump.

In particular, the J-grooves of Okamura et al. reduce the onset of back flow vortex cavitation and rotating cavitation that can be induced by the flow swirl at the inlet of the inducer.

Okamura et al. acknowledge, however, that increasing the specific speed of mixed-flow pumps has a tendency to make their performance curves unstable and to cause a big hump at low capacities, thus it is stated that it is doubtful that the illustrated technique would be effective for higher specific-speed, i.e., higher flow rate pumps.

Contra-rotating blade rows such as the stator 69 shown in FIG. 1E on or around a horizontal shaft 63 have been used for marine applications, specifically for propulsion of marine vessels. The goal in marine vessels is to improve aerodynamics and power generation. Most importantly, marine vessels generate and use high thrust forces in order to drive the marine vessels. Thus, maximizing thrust forces allows for faster and more powerful marine vessels.

SUMMARY OF INVENTION

The present invention is a variation and improvement on the configuration of inducer blades or vanes that are based on helicoid plane surface for use in vertical flow inducers. One object and advantage of the present invention is to reduce rotational momentum, increase upward flow of the liquid medium and consequently minimizes the net positive suction head required [NPSHR].

The present invention is also an inducer with improved helicoid blades in combination of an inducer housing that incorporates grooves or vanes that are helical in nature and in counter-rotation with respect to the rotation of the blades of the inducer, which grooves or vanes capture fluid rotating with the inducer blades and use that rotation to move the fluid up along the grooves or vanes and into an impeller of a centrifugal pump or other device.

The present invention is also a multi-stage inducer system that combines a rotating inducer and a non-rotating inducer. The non-rotating inducer portion use the rotational momentum of the fluid generated by the rotating inducer portion to progress the fluid forward while removing the rotational momentum, thereby increasing the NPSH.

Further details, objects and advantages of the present invention will become apparent through the following descriptions, and will be included and incorporated herein.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 1A:
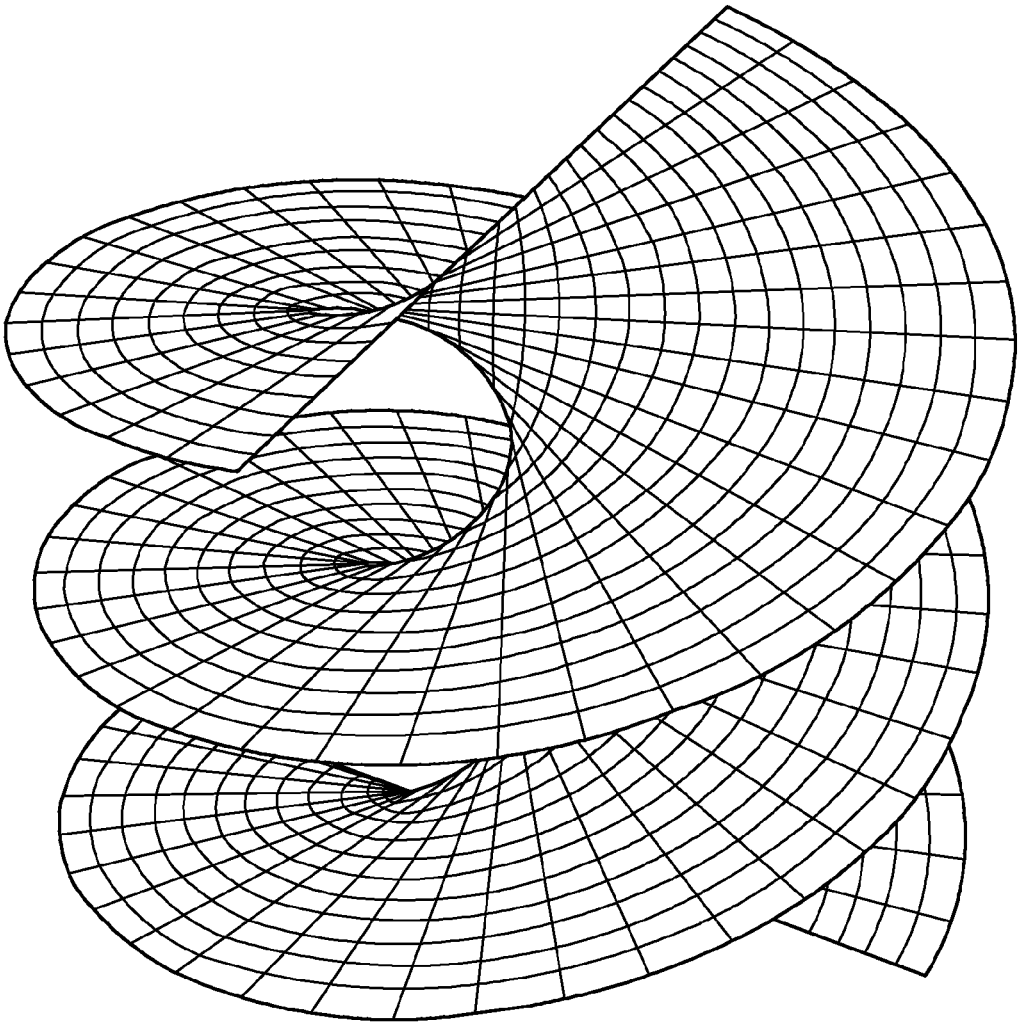
FIG. 1A (PRIOR ART)
FIG. 1A (prior art) is a representative view showing a partial plot of the helicoid plane known heretofore.
Figure 1B:
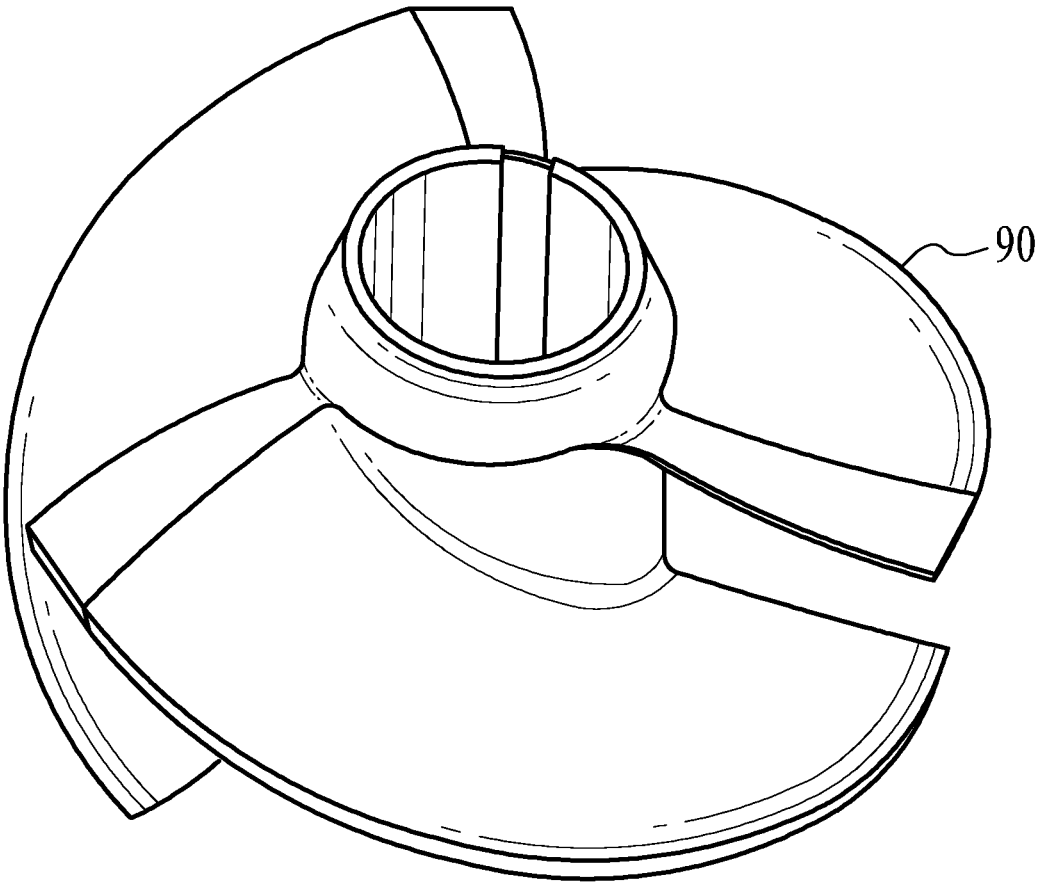
FIG. 1B (PRIOR ART)
FIG. 1B (prior art) is a representative view of an inducer for centrifugal pumps having helicoid planar surfaces currently in use 90.
Figure 1C:
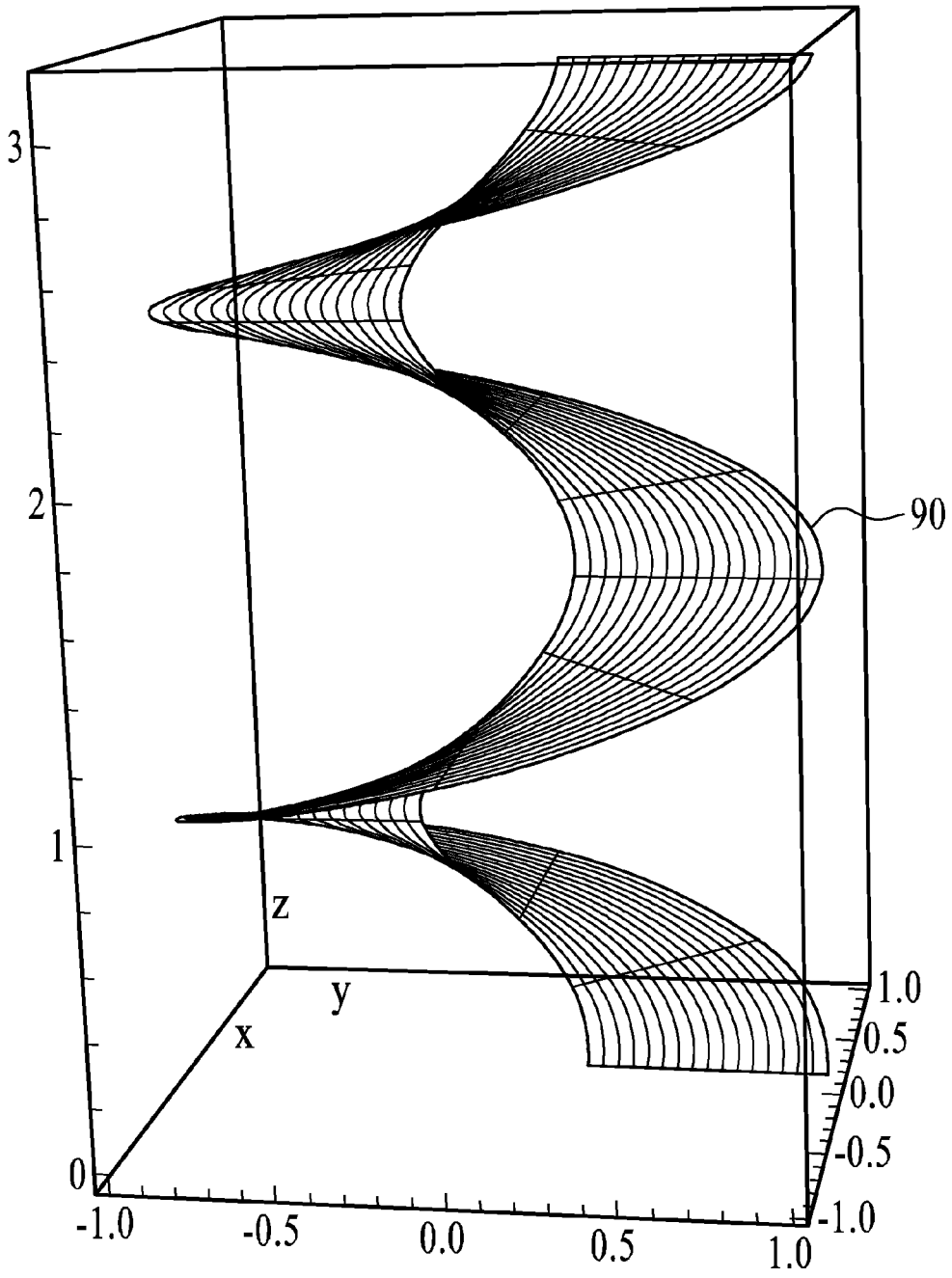
FIG. 1C (PRIOR ART)
FIG. 1C (prior art) is a representative view showing a partial plot of the helicoid plane surface of the inducer rotor currently in use 90.
Figure 1D:
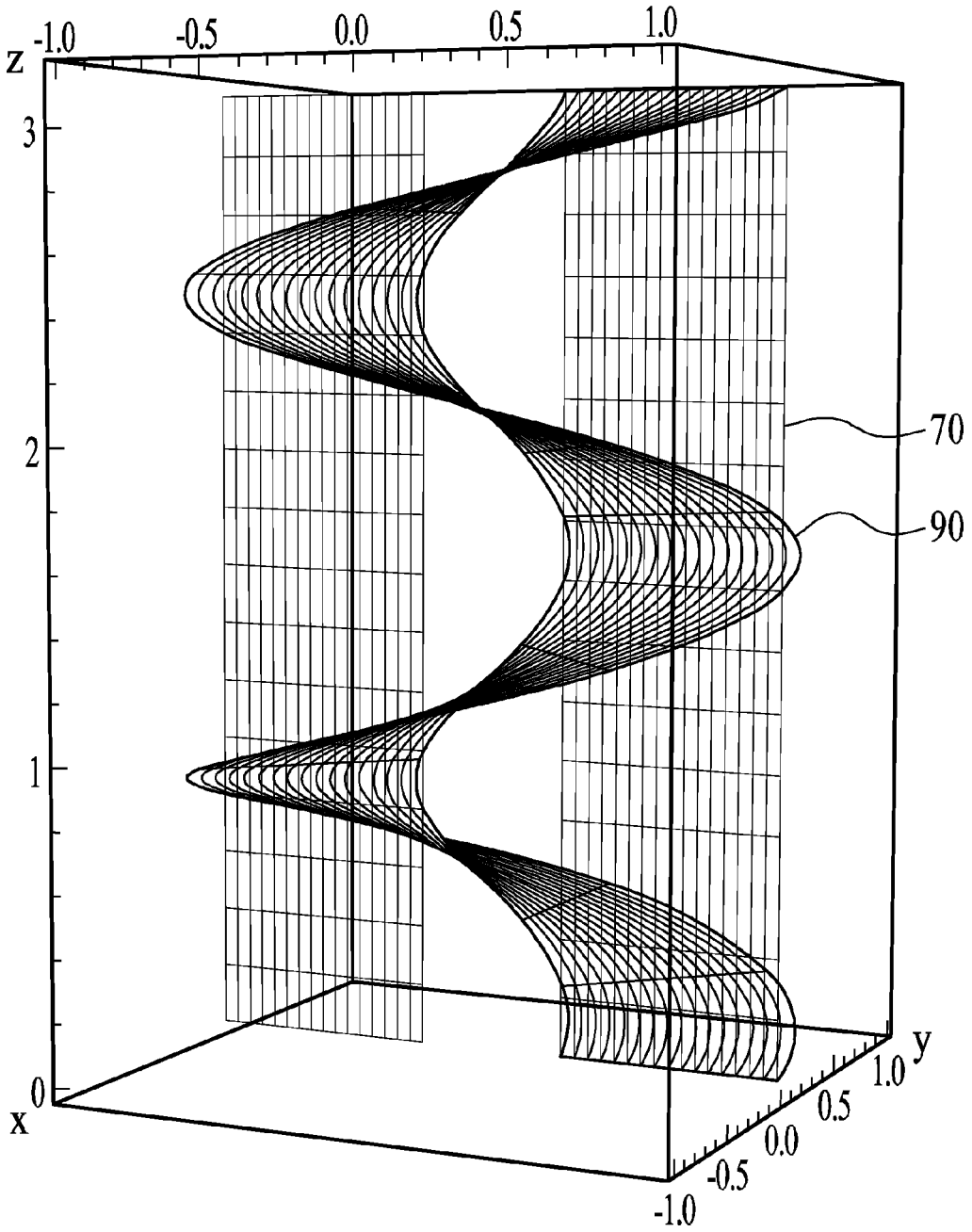
FIG. 1D (PRIOR ART)
FIG. 1D (prior art) is a representative view showing another partial plot of the helicoid plane surface and vertical bisecting plane 70 of the inducer rotor currently in use 90.
Figure 1E:
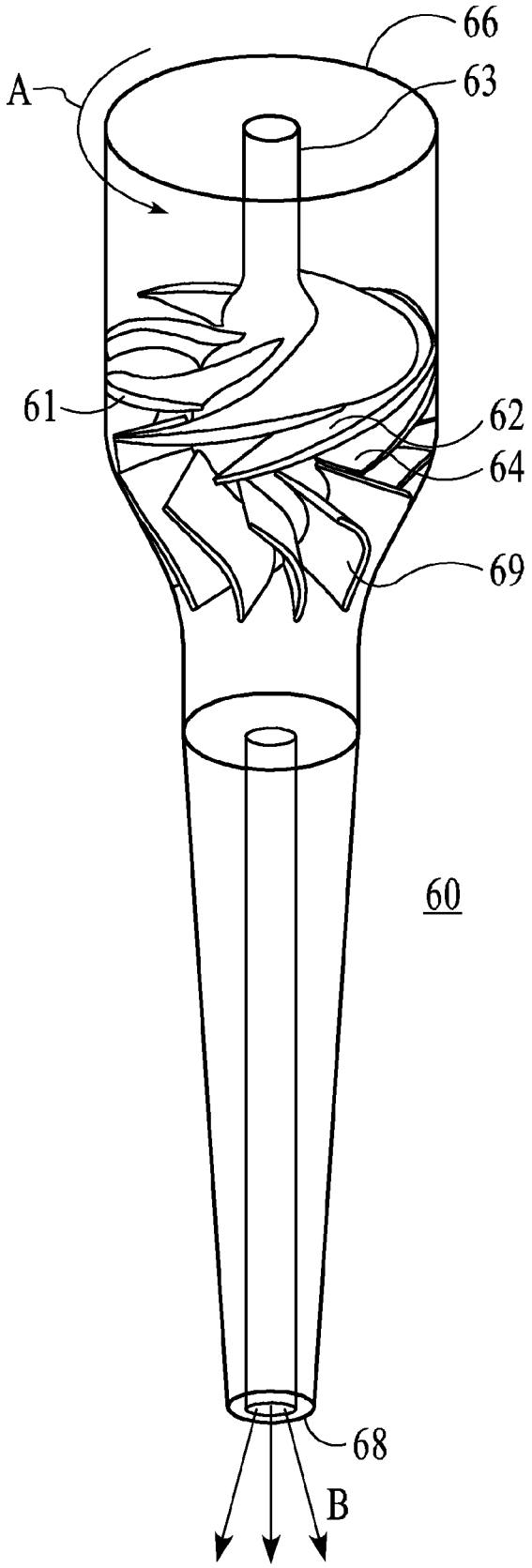
FIG. 1E (PRIOR ART)
FIG. 1E (prior art) is a representative view showing an axial water jet pump 60 such as used for propulsion of a high-speed boat currently in use.

It is common for inducer blades to be constructed strictly following the helicoid plane surface configuration, as best shown in FIG. 1C. As shown in FIG. 1D, in the presence of a vertical bisecting plane 70, it is easy to see that the intersection between the helicoid plane surface and a vertical bisecting plan on the xy plane is always a straight line parallel to the y-axis. It can be illustrated with the parametric equations of a helicoid:

$$x=\rho\cos(\alpha\theta),$$

$$y=\rho\sin(\alpha\theta),$$

$$z=\theta,$$

when z=0, θ=0 hence x=ρ as a line parallel to the y-axis.

Figure 2A:
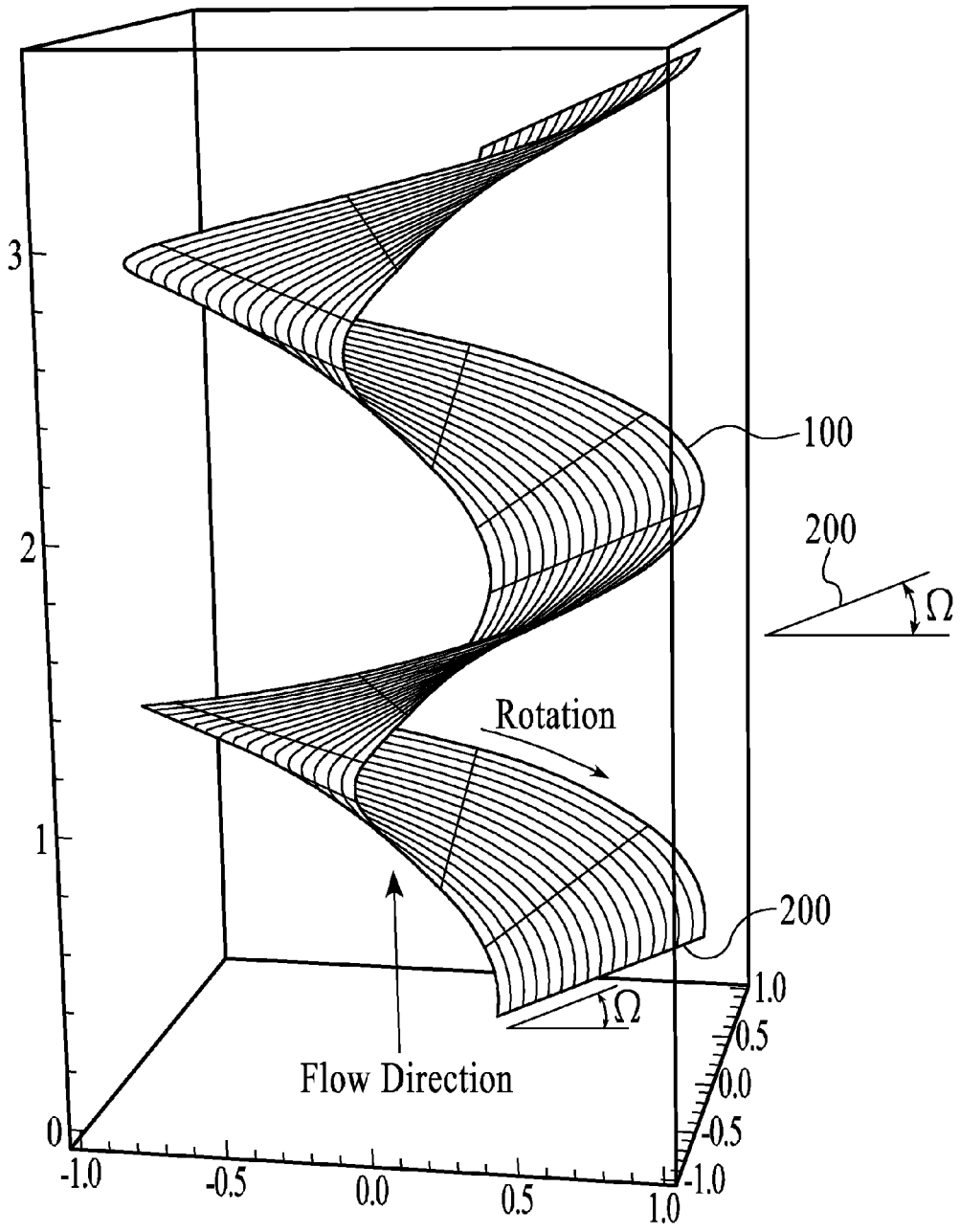
FIG. 2A is a representative view showing a partial plot of the angled blade, constant slope, helicoid plane surface 100 of an embodiment of the inducer rotor of the present invention.

FIG. 2A is a representative view showing a partial plot of the angled blade, constant slope, helicoid plane surface of an embodiment of the inducer rotor of the present invention. In one embodiment, the inducer blades of the present invention 100 adapt to the configuration and shape of a helicoid plane with a constant slope Ω. As best shown in FIG. 2A, the helicoid plane with a slope 100 does not intersect with a vertical bisecting plane 70 on the xy plane as a straight line parallel to the y-axis. Instead, the intersection is a straight line 200 that forms a slope Ω with the xy plane along the vertical bisecting plane 70. Consequently, the inducer blades are a flat plane surface with a constant slope Ω.

Figure 2B:
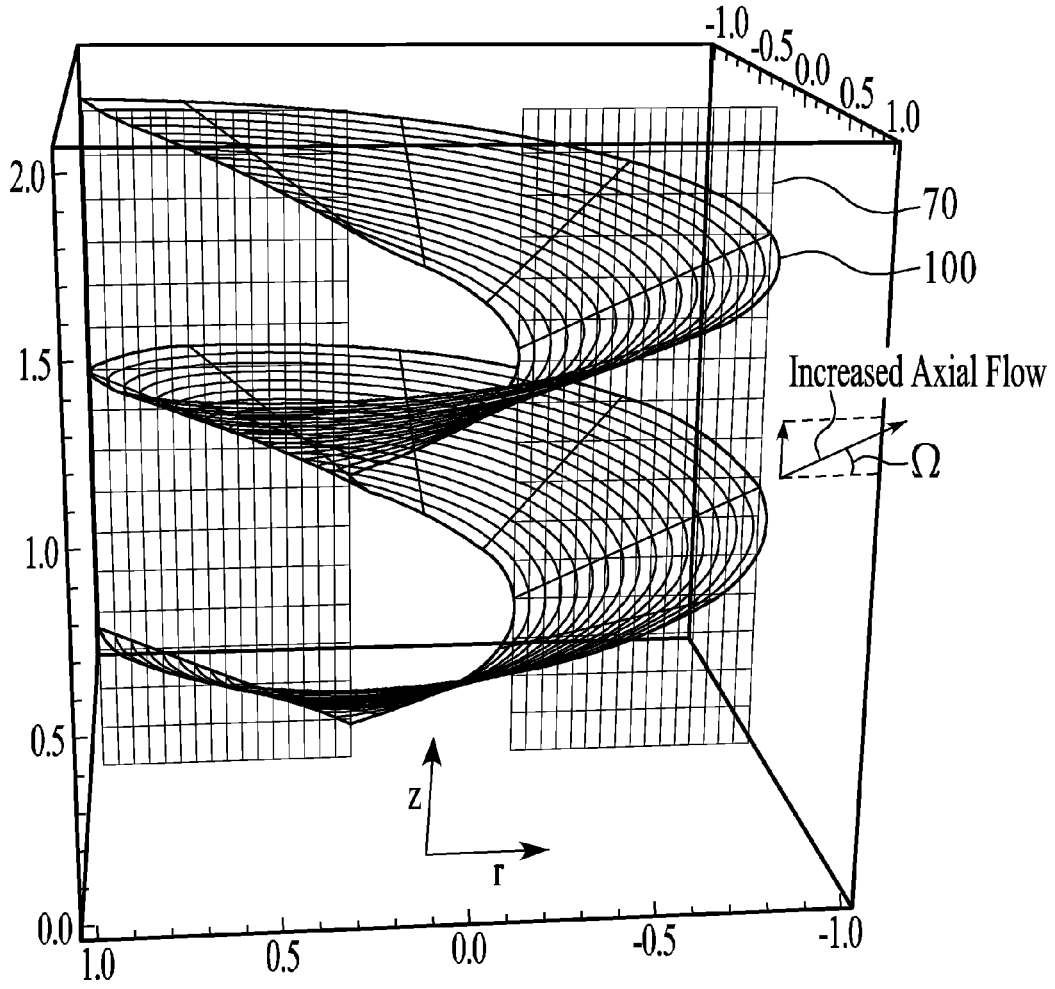
FIG. 2B is a representative view showing a partial plot of the angled blade, constant slope, helicoid plane surface 100 and vertical bisecting plane 70 of the inducer rotor of FIG. 2A.

FIG. 2B is a representative view showing a partial plot of the angled blade, constant slope Ω, helicoid plane surface 100 and vertical bisecting plane 70 of the inducer rotor of FIG. 2A. As shown in FIG. 2B, if the inducer blades are constructed according to a helicoid plane with a constant slope Ω, as the inducer rotor blades rotate, they will generate both upward flow momentum as well as rotational momentum to the liquid medium. As the inducer blades are on a constant slope, it will provide additional upward flow component due to the centrifugal forces generated and consequently lowers the NPSHR of the inducer and enhances its efficiency.

Figure 3A:
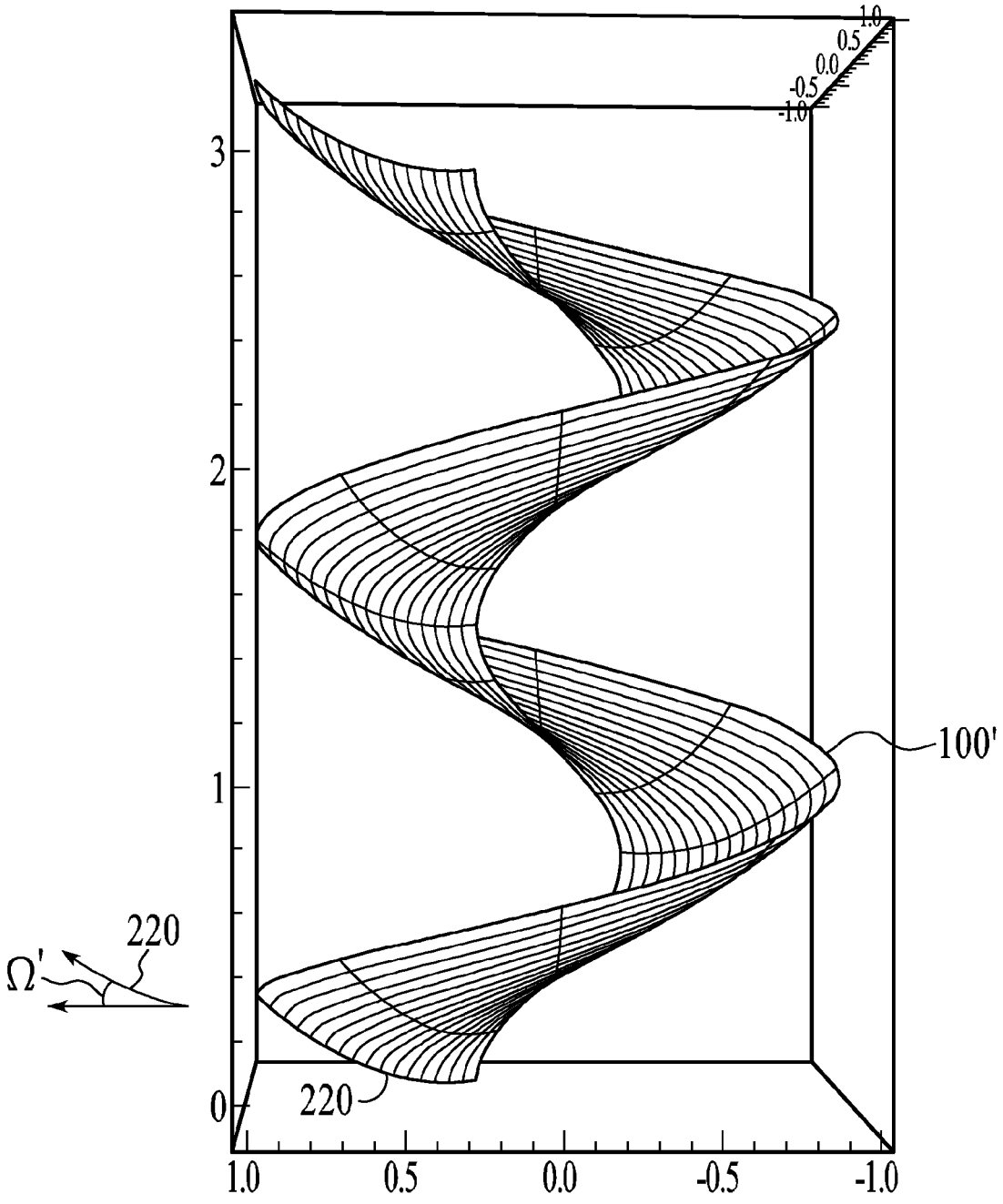
FIG. 3A is a representative view showing a partial plot of the curved blade, increasing slope, helicoid plane surface 100' of an embodiment of the inducer rotor of the present invention.

FIG. 3A is a representative view showing a partial plot of the curved blade, increasing slope, helicoid plane surface 100' of an embodiment of the inducer rotor of the present invention. FIG. 3A shows another variation of helicoid plane surface adaptation to inducer rotor blades configuration. As shown in FIG. 3A, the helicoid plane with an increasing slope 100' does not intersect with the vertical bisecting plane 70 as a straight line 200 that forms a constant slope Ω against the xy plane, as best shown in FIG. 2A. Instead, the intersection is a curve 220 that has a variable slope Ω against the xy plane along the vertical bisecting plane 70. The value of variable slope Ω' increases as the value of x and y increase. In this configuration, the inducer rotor blades will have a upwardly curved, parabolic surface instead of a plane surface as shown in FIGS. 2A and 2B. The curved surface of curved blades with the helicoid plane with an increasing slope 100' has the shape of a parabolic or a circle sector throughout the entire helicoid plane. In this particular configuration, curved blades 100' will have a parabolic curvature continually throughout the entire helicoid plane.

Figure 3B:
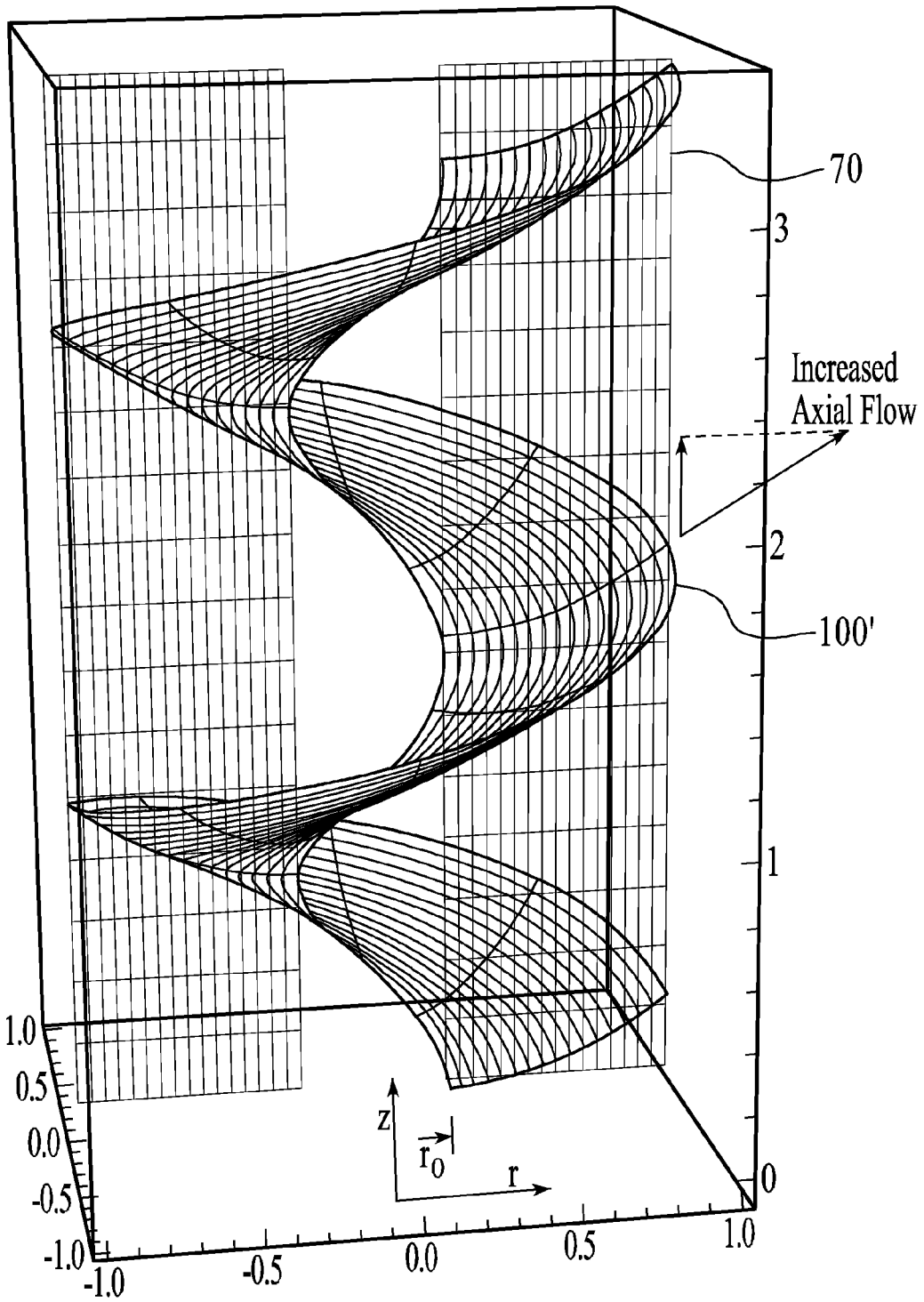
FIG. 3B is a representative view showing a partial plot of the curved blade, increasing slope, helicoid plane surface 100' and vertical bisecting plane 70 of the inducer rotor of FIG. 3A.

FIG. 3B is a representative view showing a partial plot of the curved blade, increasing slope Ω', helicoid plane surface 100' and vertical bisecting plane 70 of the inducer rotor of FIG. 3A. As shown in FIG. 3B, the variable slope Ω' increases as the curve 220 moving away from the axis of the helicoid and along the inducer rotor blades. To illustrate in a mathematical equation:

$z$=height of inducer blade from $xy$ plane, $r$=distance from inducer axis, $r_o$=$r$ increment In one embodiment, to have the slope Ω' of the curve 220 increasing with r:

$z=A(r-r_o)^2$, $A$ is a constant, which makes $z$ proportional to $(r-r_o)^2$;

In an alternative embodiment, to have the slope Ω' of the curve 220 increasing with r:

$z$ is proportional to $f(r)$, where $f(r)$ is a function of $r$ with $(\partial f(r)/\partial r)\geq 0$.

As shown in FIG. 3B, if the inducer blades are constructed according to a curved helicoid plane with a variable slope Ω' 100', as the inducer rotor blades rotate, they will generate both upward flow momentum as well as rotational momentum to the liquid medium. As the inducer blades are on a variable slope Ω', they will increase the component of axial or radial (both inward and outward) flow further as well as increase upward flow. Moreover, the NPSHR of the inducer is consequently lowered and its efficiency is enhanced.

Figure 4A:
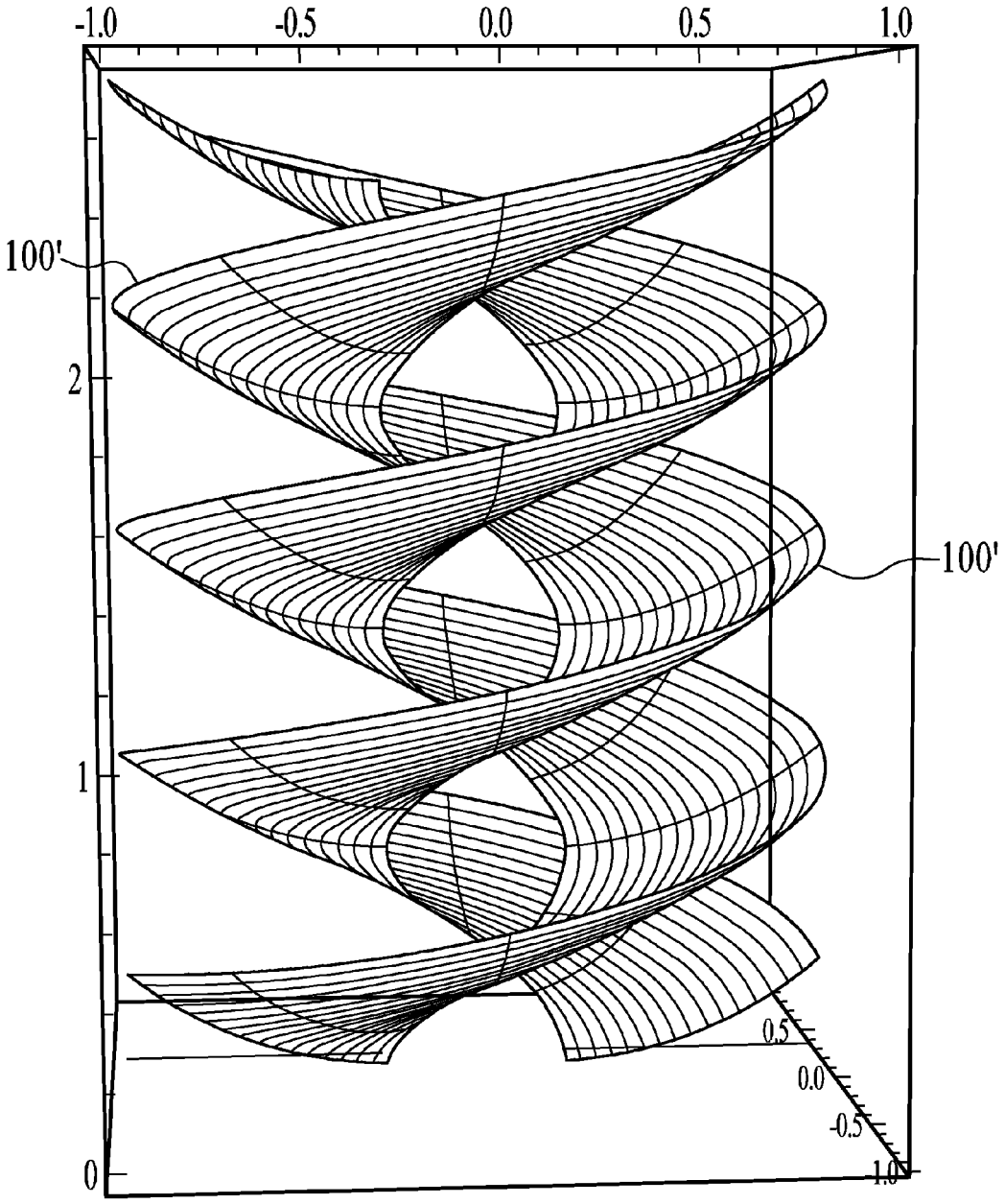
FIG. 4A is a representative view showing a partial plot of the curved blade, increasing slope, dual helicoid plane surfaces 100' of an embodiment of the inducer rotor of the present invention.

FIG. 4A is a representative view showing a partial plot of the curved blade, increasing slope, dual helicoid plane surfaces 100' of an embodiment of the inducer rotor of the present invention. To further increase efficiency of inducer, two identical or different helicoid inducer blades can be constructed along a single inducer shaft such that the plot of helicoid planes is as shown in FIG. 4A. As shown, each inducer blade is of a helicoid curved surface with an increasing slope 100' as best shown in FIGS. 3A and 3B. The configuration of both blades can be identical or different as long as they do not intercept with each other.

Figure 4B:
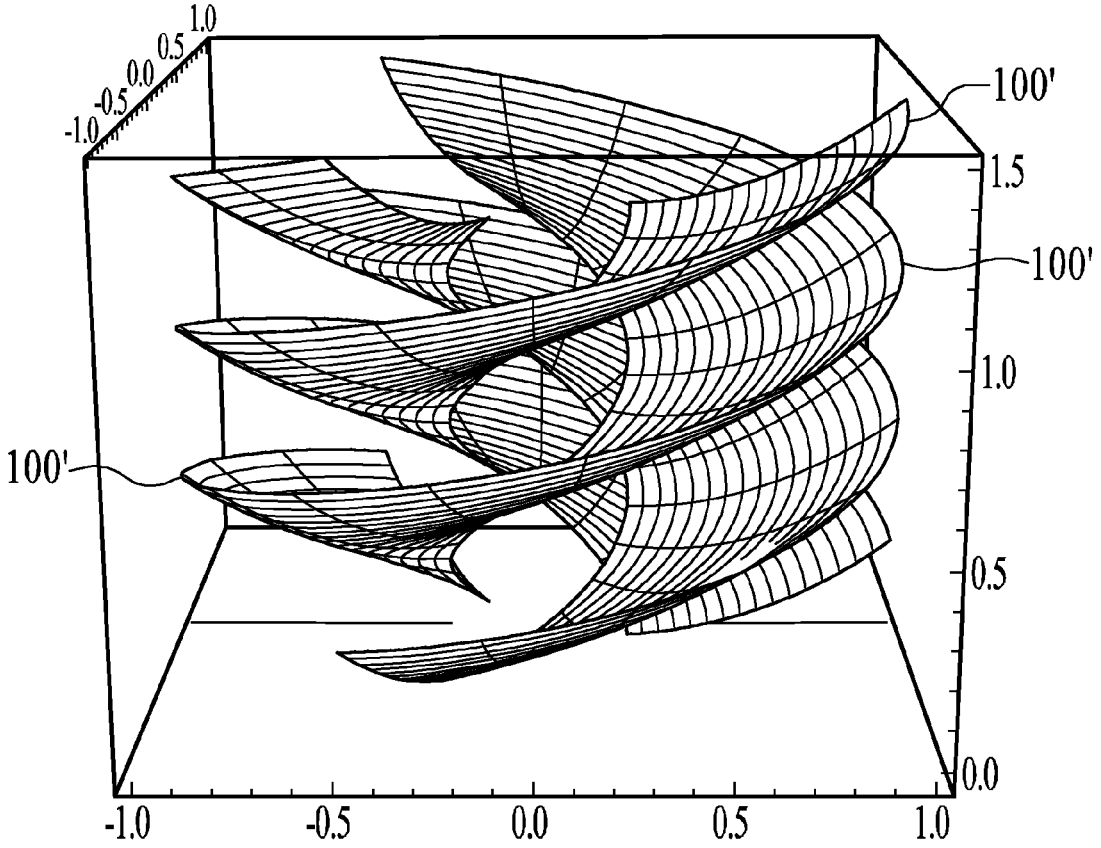
FIG. 4B is a representative view showing an embodiment of a curved blade, increasing slope, multi-helicoid plane surfaces 100' inducer rotor of the present invention.

FIG. 4B is a representative view showing an embodiment of an increasing slope, multi-helicoid plane surfaces inducer rotor of the present invention. As describe previously, the same concept can be applied when more than two inducer blades are constructed in the same inducer. As best shown in FIG. 4B, three identical or different helicoid plane inducer blades are constructed around the rotor axis. As shown, each inducer blade is of a helicoid curved surface with an increasing slope 100'. The configuration of the three or more blades can be identical or different as long as they do not intercept with each other. In general, the more number of inducer blades are introduced, the better overall efficiency of the inducer can be achieved.

The inducer blades having a curved surface with a helicoid configuration with an increasing slope 100' as best described in FIGS. 3A, 3B can be applied to existing inducer system such as a multi-stage inducer. The introduction of the said curved inducer blades will further enhance the efficiency of any inducer existing system.

The embodiment is directed to inducers, and more particularly to an inducer that incorporates sets of curved rotating helical inducer blades and sets of curved non-rotating helical inducer vanes. A first set of curved rotating vanes move the fluid up along the vanes. The sets of curved helical vanes are set in alternating stages, with a rotating inducer vane stage followed by a non-rotating inducer vane stage, and so on. The number of stages used before the fluid leaves the inducer and enters the impeller, or some other structure, can be varied depending upon the fluid and the process conditions, such as the structure size, but should include at least two sets. Embodiments of the multi-state inducer can be positioned at the inlet of a cryogenic centrifugal pump. Alternative embodiments can be positioned at the inlet of a cryogenic centrifugal pump with a vertical rotational axis and a thrust equalizing mechanism device.

The fluid gains rotational momentum as a result of passing through the rotating vanes. Such rotational momentum can be detrimental to the net positive suction head (NPSH) if the fluid fails to actually move up through the inducer due to its rotation momentum. A set of non-rotating vanes is used to counter the rotational momentum gained by the fluid. The non-rotating vanes use the rotational momentum of the fluid to progress the fluid forward while removing the rotational momentum of the fluid, thereby increasing the NPSH. Embodiments of the present invention keep the NPSHR of the pump lower and provide a smooth and constant increase in fluid pressure, which makes the pump more efficient because it is capable of removing more fluid from the tank.

Figure 5A:
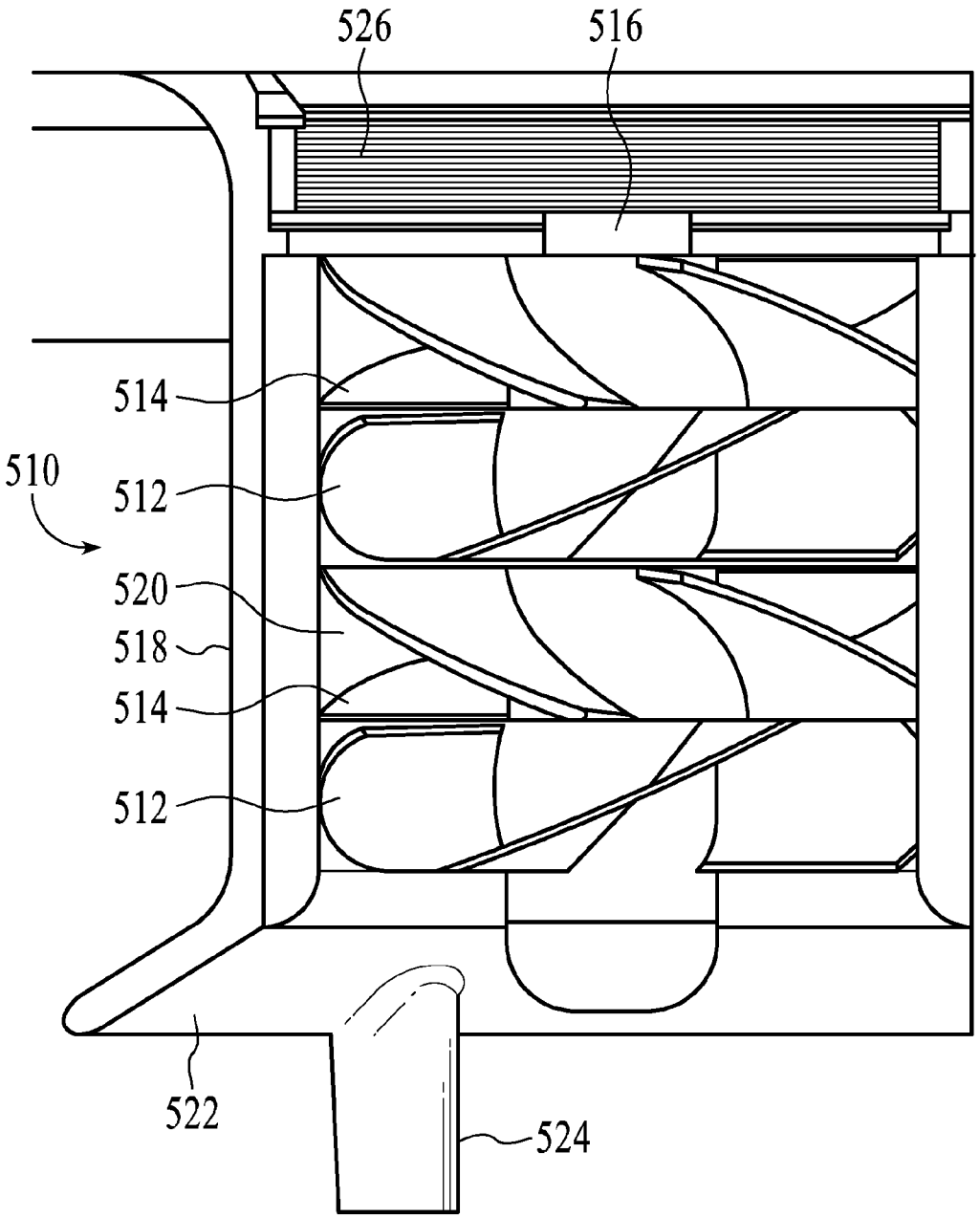
FIG. 5A is a representative partially broken, cross-sectional, side view of an embodiment of an curved blade, increasing slope, triple helicoid plane surface, multi-stage inducer rotor of the present invention.

FIG. 5A is a representative partially broken, cross-sectional, side view of an embodiment of an increasing slope, triple curved helicoid plane surface, multi-stage inducer rotor of the present invention. FIG. 5A is an embodiment of an inducer assembly 510 including curved rotating blades 512 and curved non-rotating vanes 514 within the space formed within the inducer assembly 510. The curved rotating blades 512 are mounted on a shaft 516 and rotate within the interior space formed by the outer inducer housing 518. The non-rotating vanes 514 are in axial alignment with the shaft 516 and can slide up a shaft sleeve (not shown) of the shaft 516 and then be fixed to a circular interior wall 520 of the outer inducer housing 518 to keep the non-rotating vanes 514 from rotating as the shaft 516 rotates. In an alternative embodiment, the non-rotating vanes 514 are in axial alignment with the shaft, but are machined or formed into the circular interior wall 520, rather than sliding onto the shaft 516 or onto the shaft sleeve.

The substantially bell-shaped inlet 522 to the inducer 510 is raised off of the bottom surface of a tank or other structure (not shown) by the feet 524 so fluid (not shown) in the tank or structure can enter and be funneled toward the inducer 510 and be moved up into another device mounted above the inducer 510, such as an impeller.

The curved rotating blades 512 of FIG. 5A are helical curved structures that spiral in a first direction, in this case around the vertical rotational axis of the shaft 514, and occupy a first annular space within a first portion of the inducer housing between the outer surface of the shaft 516 and the interior wall 520 of the outer inducer housing 518. The non-rotating vanes 514 are helical structures that spiral in a second direction that is counter rotation to the first direction of the curved rotating blades 512, and occupy a second annular space along a second portion of the inducer housing. FIG. 5A illustrates a first stage consisting of curved rotating blades 512 that spiral in the first direction. The second stage consists of non-rotating vanes 514 spiraling in the second direction. The third stage consists of curved rotating blades 512 spiraling in the first direction, occupying a third annular space along a third portion of the inducer housing, followed by the last stage of non-rotating vanes 514 spiraling in the second direction, etc.

Alternative embodiments may have a different number of stages. For example, a first embodiment may consist of two stages: a curved rotating blade 512 stage near the inlet, and a non-rotating blade 514 stage on top of the curved rotating vane 512 stage, near the impeller or other structure. A second embodiment may consist of three stages: a curved rotating blade 512 stage near the inlet, a non-rotating blade 514 stage on top of the curved rotating blade 512 stage, and a second curved rotating blade 512 stage on top of the non-rotating vane 514 stage. Any other number of two or more rotating and non-rotating stages may also be used. Ideally the rotating and non-rotating stages alternate, enabling the non-rotating vane 514 stages to remove the rotational momentum of the fluid. However, as has been described above, a multi-stage inducer 510 may have either a curved rotating blade 512 stage or a non-rotating vane 514 stage as the last stage before the fluid leaves the inducer 510.

The width of the curved rotating blades 512 and the width of the non-rotating vanes 514 can be different, with the difference depending upon the fluid or structure and the process conditions. For example, the first stage may consist of curved rotating blades 512 with a first width, followed by non-rotating vanes 514 with a second width. The blade width of curved rotating blades 512 can also vary across stages. For example, if there are a total of four stages, consisting of two curved rotating blade 512 stages and two non-rotating blade 514 stages, then the first curved rotating blade 512 stage may have blades with a different width than the second curved rotating blade 512 stage. Similarly, the first curved non-rotating vane 514 stage may have blades with a different width than the second curved non-rotating vane 514 stage.

An alternative embodiment has a curved rotating blade 512 that has a different pitch from the pitch of the curved non-rotating vane 514. The blade pitch across curved rotating blade 512 stages can also be varied depending upon the fluid and the process conditions. For example, the blade pitch of a first curved rotating blade 512 stage can be different than blade pitch of a second curved rotating blade 512 stage. Similarly, the blade pitch across curved non-rotating vane 514 stages can be varied. Alternative embodiments may also design the curved rotating blades 512 differently than the curved non-rotating vanes 514, such as using a different number of blades or having different blade lengths.

Accordingly, as noted above, the number of stages used can range from using at least two sets of rotating blade stages followed by non-rotating blade stages, to as many sets and stages as are necessary to produce an NPSHR of the pump that is less than the NPSHA of the tank or structure, which may vary based on the type of fluid being held by the tank, the liquid depth of the tank housing the pump, among other factors. In particular, the curved non-rotating vanes 514 move fluid that is not being propagated up through the inducer 510 by the curved rotating blades 512 because the fluid is rotating with the blades 512. More efficiently moving the fluid up through the inducer increases the NPSH (head) so, for example, a pump attached to the inducer 510 can pump the fluid to a lower level within the tank or structure and thus increase the capability and efficiency of the pump. The lowest fluid level a tank or structure can be pumped to is related to the point at which NPSHA is equal to or greater than the NPSHR. However, when NPSHA and NPSHR are close to equal, it is likely that vapor bubbles will form, which can lead to cavitation as pressure is increased within the inducer. Stopping vapor bubbles from forming in the fluid, a focus of other inducers, is not a purpose of the combination of the rotating blades 512 and the non-rotating vanes 514 described herein, since vapor bubbles can form in any tank when the level of the fluid is pumped to the point where there is not sufficient NPSHA. Rather, embodiments disclosed herein seek to lower the NPSHR of the pump and to increase the efficiency of the pump, or other structure, so that the fluid in the tank or structure can be pumped to a lower level. Embodiments also keep the NPSHR of the pump lower and provide a smooth and constant increase in fluid pressure, which prevents cavitation and makes the pump more efficient because it is capable of removing more fluid from the tank.

Figure 5B:
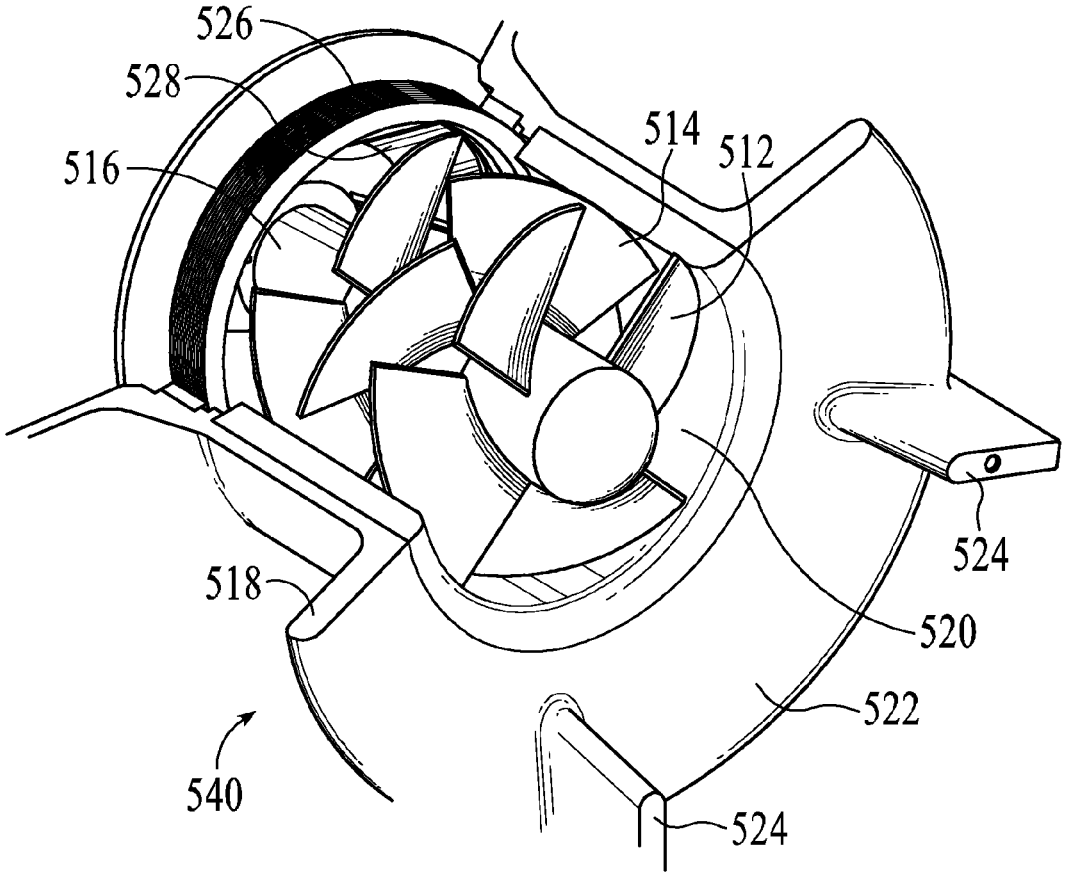
FIG. 5B is a representative partially broken, cross-sectional perspective, lower side view of an embodiment of a curved blade, increasing slope, triple helicoid plane surface, multi-stage inducer rotor of the present invention.

FIG. 5B is a representative partially broken, cross-sectional perspective, lower side view of an embodiment of an increasing slope, triple helicoid plane surface, multi-stage inducer rotor of the present invention. The stages of the alternating rotating curved blades 512 and non-rotating vanes 514 can extend all of the way into the outlet 526 of the inducer 510. FIG. 5B illustrates a different view of an inducer assembly 540, looking from the bottom of the inducer assembly 540 towards an impeller 528. The inducer assembly 540 is similar to the inducer assembly 510 from FIG. 5A, except that inducer assembly 540 illustrates an embodiment with three stages of alternating curved rotating blades 512 and non-rotating vanes 514 instead of four stages. The three stages are a rotating blades 512 stage, followed by a non-rotating vanes 514 stage, and ending with a second curved rotating blades 512 stage. As the fluid leaves the last set of rotating blades 512 and leaves the inducer 540, the fluid enters the impeller 528.

Embodiments of at least two curved rotating blades 512 and at least two non-rotating vanes 514 provide a lower suction head than is possible with a single set of alternating rotating blades 512 and non-rotating blades 514. However, using at least two sets of rotating blades 512 and non-rotating vanes 514 increases the design complexity and the complexity of assembly. It also significantly increases the possibility for the pump to be damaged if any torque or other motion of the shaft of the pump causes a set of rotating blades to contact a set of non-rotation blades.

Figure 5C:
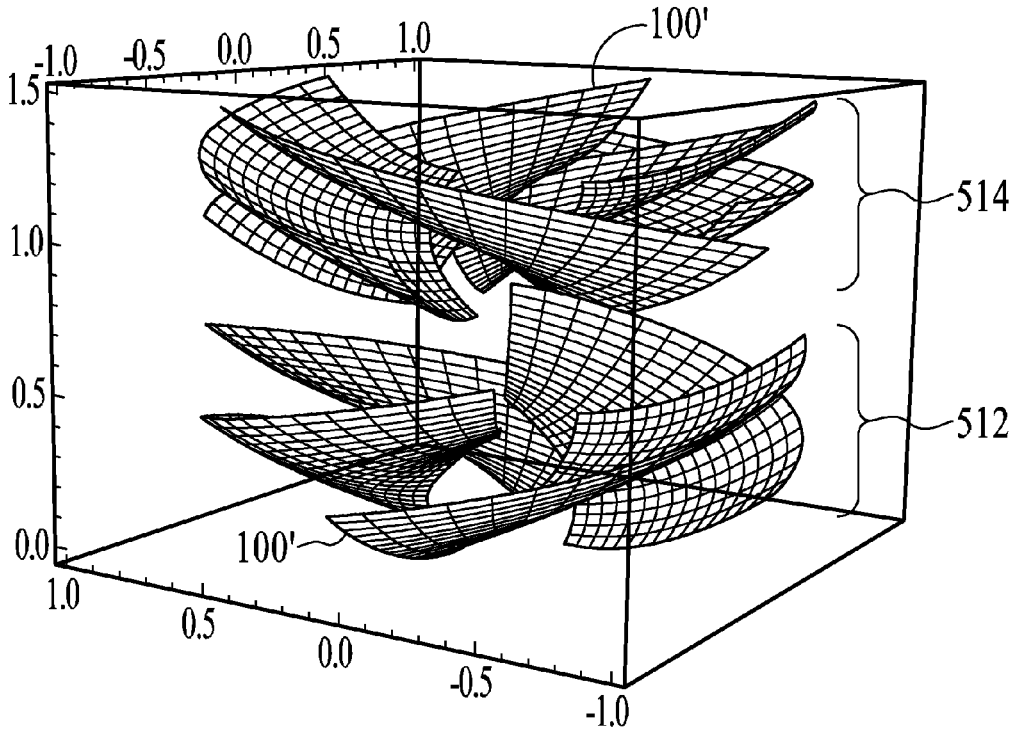
FIG. 5C is a representative view showing a partial plot of a curved blade, increasing slope, triple helicoid plane surface 100', multi-stage inducer rotor of an embodiment of the present invention.

FIG. 5C is a representative view showing a partial plot of a curved blade, increasing slope, triple helicoid curved plane surface 100', multi-stage inducer rotor of an embodiment of the present invention. As shown in FIG. 5C, the lower set is an embodiment of at least two curved rotating helicoid curved blades 512 and the upper set is an embodiment of at least two curved non-rotating helicoid curved vanes 514.

Figure 5D:
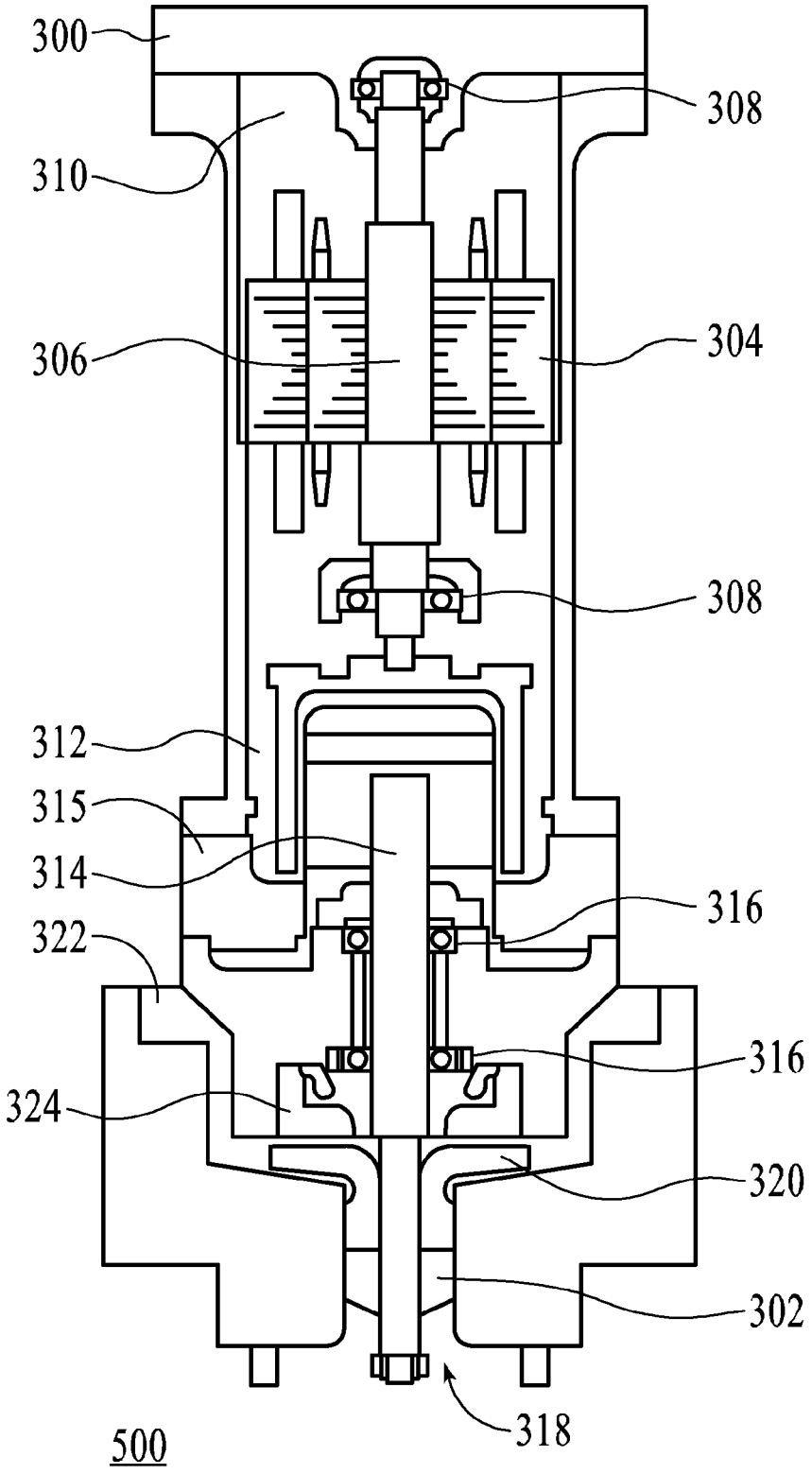
FIG. 5D is a representative section view showing an inducer rotor of an embodiment of the present invention coupled via TEM to a centrifugal pump.

FIG. 5D is a representative section view showing an assembly 500 having an inducer rotor of an embodiment of the present invention coupled via TEM to a centrifugal pump. FIG. 5D illustrates an assembly 500 consists mainly of a submerged, magnetically coupled cryogenic centrifugal pump 300, with the pump 300 including an inducer 302 with alternating stages of rotating blades and non-rotating blades in accordance with an embodiment. Embodiments of the inducer 302 decrease the net positive suction head required of the pump 300. In contrast to other types of centrifugal pumps with a horizontal rotational axis, the pump 300 is an example of a cryogenic centrifugal pump with a vertical rotational axis, which is important relative to the management and control of the movement of the shaft, as described below.

The pump 300 includes a motor 304 mounted on a motor shaft 306. The motor shaft 306 is supported by dry side ball bearings 308. The pump embodiment illustrated in FIG. 5D has the motor housing 310 purged with nitrogen to remove all oxygen, to keep the spaces on the motor housing 310 inert and free from moisture, and to maintain the proper pressure balance on both sides of the magnetic coupling 312. Other mostly inert gases or fluids can also be used instead of nitrogen. The motor 304 causes the motor shaft 306 to turn. The turning of the motor shaft 306 causes a magnetic difference in the magnetic coupling 312, with the magnetic coupling 312 transferring the power from the motor shaft 306 to the pump shaft 314. The pump shaft 314 is housed within a pump housing 315 and is supported by wet side ball bearings 316. Fluid enters the pump 300 through the inlet flow 318 at the bottom of the pump 300. The fluid then goes through the various stages of inducer 302 and impeller 320.

The pump shaft 314 transfers the rotational power to the inducer 302 and the impeller 320. The impeller 320 increases the pressure and flow of the fluid being pumped. After the fluid goes through the impeller 320, the fluid exits through the discharge flow path 322.

The magnetic coupling 312 consists of two matching rotating parts, one rotating part mounted on the motor shaft 306 and one rotating part mounted on the pump shaft 314 next to each other and separated by a non-rotating membrane mounted to the motor housing 310. In alternative embodiments, the non-rotating membrane can be mounted to the pump housing 315. The operation of a magnetic coupling is known in the art.

While the pump 300 is illustrated having a magnetic coupling 310, embodiments are not limited to pumps with a magnetic coupling 310. Other means for transferring the rotational energy from the motor shaft 306 to the pump shaft 314 are within the scope of embodiments. Similarly, embodiments are not limited to pumps with a motor shaft 306 and a pump shaft 314. Alternative embodiments can consist of a pump with a single shaft or with more than two shafts.

The pump 300 uses a Thrust Equalizing Mechanism (TEM) device 324 for balancing hydraulic thrust. The TEM device 324 ensures that the wet side ball bearings 316 are not subjected to axial loads within the normal operating range of the pump 300. The wet side ball bearings 316 are lubricated with the fluid being pumped. When using the fluid being pumped for lubrication, it is imperative that the axial thrust loads are balanced to prevent vaporization of the fluid in the bearings, thereby ensuring reliability. Axial force along the pump shaft is produced by unbalanced pressure, deadweight and liquid directional change. Self adjustment by the TEM device 324 allows the wet side (product lubricated) ball bearings 316 to operate at near-zero thrust load over the entire usable capacity range for expanding. This consequently increases the reliability of the bearings. The TEM device 324 also prevents damage to the alternating curved rotating blades 512 and non-rotating blades 514 due to unbalanced thrust loads. Unbalanced thrust loads can cause the curved rotating blades 512 to collide against the non-rotating blades 514, causing severe damage to the multi-stage inducer and the pump. Thus, the TEM device 324 increases the reliability of the various components of the pump, including the multi-state inducer, and reduces equipment maintenance requirements. Alternative embodiments of cryogenic pumps may not include the TEM device 324.

Embodiments of the multi-state inducer described herein improve on common centrifugal pumps and the use of contra-rotating blade rows in other applications, including but not limited to marine vessels, in a number of ways. First, embodiments of the multi-stage inducer are directed to cryogenic applications, where the goal is to maintain fluid flow and prevent the cryogenic fluid being pumped from cavitating. Cavitation is prevented or reduced by having a low NPSHR. Reducing cavitation and lower NPSHR in a cryogenic centrifugal pump and maximizing thrust forces to drive a marine vessel are completely different hydraulic goals. In fact, embodiments of cryogenic centrifugal pumps that use the herein disclosed multi-stage inducer balance and counteract high thrust forces rather than maximizing them. Balancing thrust forces is important in embodiments because thrust forces can damage components of the pump and the vessel housing the pump. As discussed above, the TEM device balances the up-thrust generated by the pump impeller by counteracting the unbalanced pressure and resultant axial force across the impeller. Thus, rather than maximizing thrust loads as is typical of marine applications, embodiments of cryogenic pumps equipped with the TEM device balance thrust loads to prevent damage to the pump. Embodiments of cryogenic centrifugal pumps equipped with the multi-stage inducer also use a vertical rotational axis rather than the horizontal axis. It is more difficult to balance and manage thrust loads along a horizontal axis.

The multi-stage inducer used in conjunction with the angled and curved impeller blades described herein is further described and detailed in U.S. patent application Ser. No. 12/849,729 filed Aug. 3, 2010 entitled MULTI-STAGE INDUCER FOR CENTRIFUGAL PUMPS, which claims benefits of U.S. Provisional Application No. 61/273,377 filed Aug. 3, 2009 entitled MULTI-STAGE INDUCER FOR CENTRIFUGAL PUMPS, which is incorporated herein by reference in its entirety, and claims any and all benefits to which it is entitled therefrom.

Figure 6A:
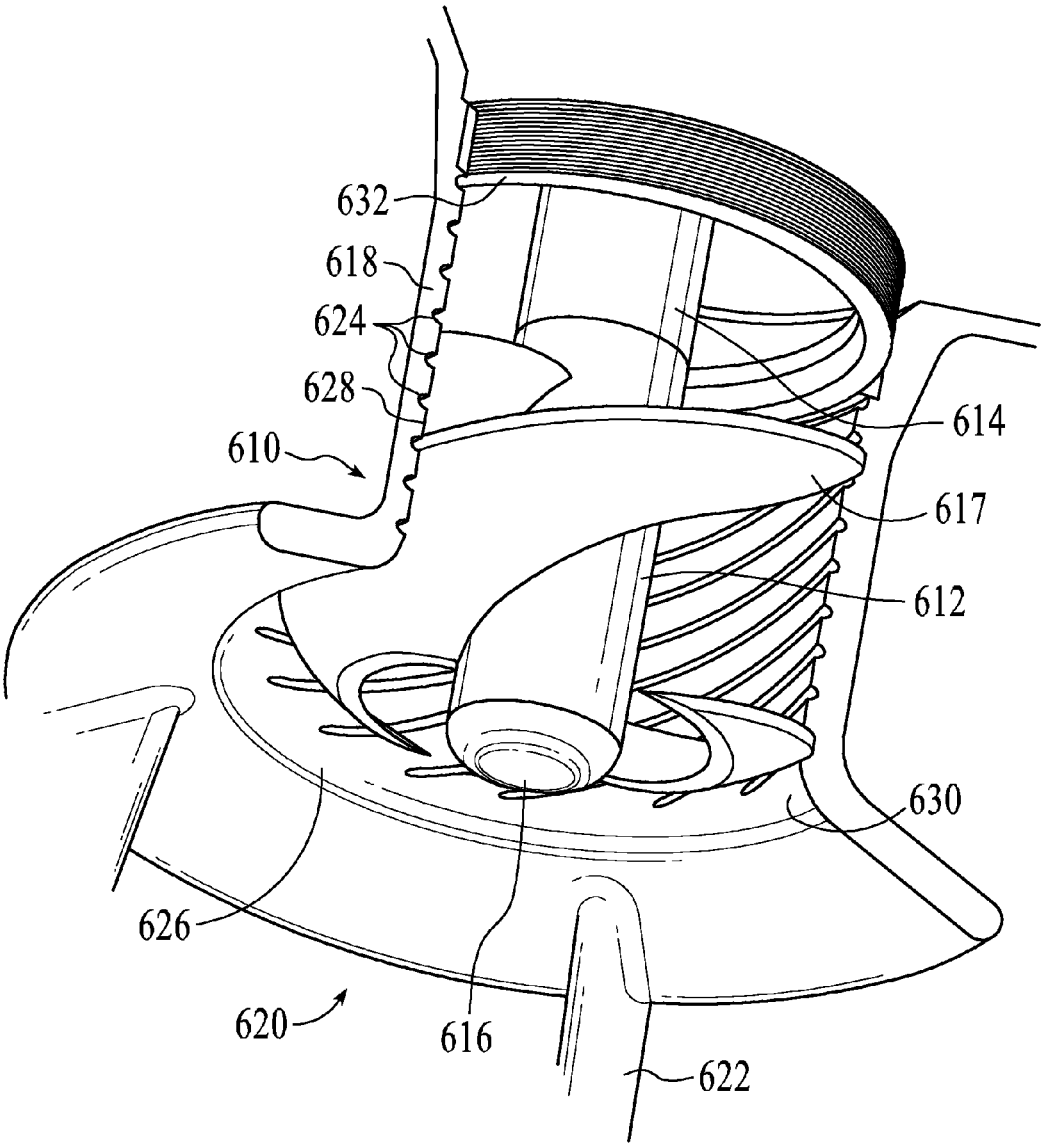
FIG. 6A is a representative partially broken, cross-sectional perspective, lower side view of an embodiment of a curved blade, increasing slope, helicoid plane surface, grooved housing inducer rotor of the present invention.

FIG. 6A is a representative partially broken, cross-sectional perspective, lower side view of an embodiment of a curved blade 617, increasing slope, helicoid curved plane surface 100', grooved housing inducer rotor assembly 610 of the present invention. In one embodiment, as best shown in FIG. 6A, inducer rotor assembly 610 of the present invention consists essentially of an auger 612 mounted on a shaft 614, with a hub 616 and curved inducer blades or vanes 617, rotating within an outer inducer housing 618. The substantially bell-shaped inlet 620 to the inducer rotor assembly 610 is raised off of the bottom surface of a tank or other structure [not shown] by the feet 622 so fluid [not shown] in the tank or structure can enter and be funneled toward the inducer rotor assembly 610 and be moved up into another device mounted above the inducer rotor assembly 610, such as an impeller or a pump. The curved inducer blades 617 of auger 612 of FIG. 6A are helical structures that spiral in a first direction, in this case around the axis of the shaft 614 of the auger 612. An embodiment is directed to inducers, and more particularly to a combination of curved inducer blades 617 with an increasing slope, helicoid curved plane surface 100' and a housing for an inducer that incorporates grooves 624 [best shown in FIG. 6A] or vanes 662 [best shown in FIG. 6B] that are helical in nature and in counter rotation with respect to the rotation of the curved inducer blades 617 of the inducer rotor assembly 610, which grooves 624 or vanes 662 capture fluid rotating with the curved inducer blades 617 and use that rotation to move the fluid up along the grooves 624 or vanes 662 and into an impeller, pump or other device.

A series of helical grooves 624 are machined or formed into the circular interior wall 628 of the outer housing 618, either after the inlet (such that they start at the interior wall 628) or starting at a transition area 626 between the inlet 620 and the interior wall 628. The grooves 624, for example, can start out in the transition area 626 with a tapered section 630 and then form one or more semi-circular grooves 624 within the interior wall 628. As noted, the grooves 624 have a substantially helical shape that spirals in a second direction that is counter rotation to the first direction of the blades 617 of the auger 612. The grooves 624 can vary in depth and width, and the number of grooves 624 is dependent upon the fluid in the tank or structure and the process conditions.

Accordingly, as noted above, the number of grooves 624 can range from one groove 624 to as many grooves 624 as are necessary to maintain a lower NPSHR in the tank or structure. In particular, the one or more grooves 624 move fluid that is not being propagated up through the inducer 610 by the curved blades 617 because the fluid is rotating with the curved blades 617. More efficiently moving the fluid up through the inducer increases the NPSH (head) so, for example, a pump attached to the inducer 610 can pump the fluid to a lower level within the tank or structure and thus increase the capability and efficiency of the pump. The lowest fluid level a tank or structure can be pumped to is related to the point at which cavitation can occur because there is not enough NPSHA to prevent a vacuum. However, stopping cavitation from occurring is not a purpose of the grooves 624, since it will occur in any tank when the level of the fluid is pumped to the point where NPSHA cannot prevent a vacuum. Hence, a purpose of the present invention is to increase the efficiency of the pump so that the fluid in the tank or structure can be pumped to a lower level.

The grooves 624 can extend all of the way into the outlet 632 of the inducer 610. The counter rotation of the grooves 624 captures at least a portion of the fluid that is rotating with the blades 617 by pushing it into the grooves 624 and then uses that counter rotation to move the fluid up a path formed by the grooves 624 to the outlet 632 and into the structure above the inducer 610, such as an impeller. Since the helical pattern of the grooves 624 is counter to the helical pattern of the curved blades 617, the portion of the fluid pushed into the grooves 624 readily follows the path formed by the grooves 624 up the sides of the wall 628. If the grooves 624 had a helical pattern that was not counter to curved blades 617, the blades would be constantly cutting across the path of the grooves 624 and the fluid would not be able to follow the path. The curved blades 617 need to be positioned sufficiently so that fluid cannot readily escape between the wall 628 and the curved blades 617. As shown, multiple rings comprising a labyrinth-type seal are located at the outlet end 632 of the inducer 610.

Although the grooves 624 and curved blades 617 are shown following an even spiral pattern, other patterns could also be used, as long as the pattern for the curved blades 617 matches the reverse pattern for the grooves 624. Hence, if the pattern of the blades became tighter as it progressed toward the outlet 632, the pattern for the grooves 624 would also have to become tighter, by an equal degree, as the grooves 624 moved up the interior wall 628, so as to prevent the curved blades 617 from cutting across the grooves 624 instead of allowing fluid around the curved blades 617 to follow the path of the grooves 624.

Figure 6B:
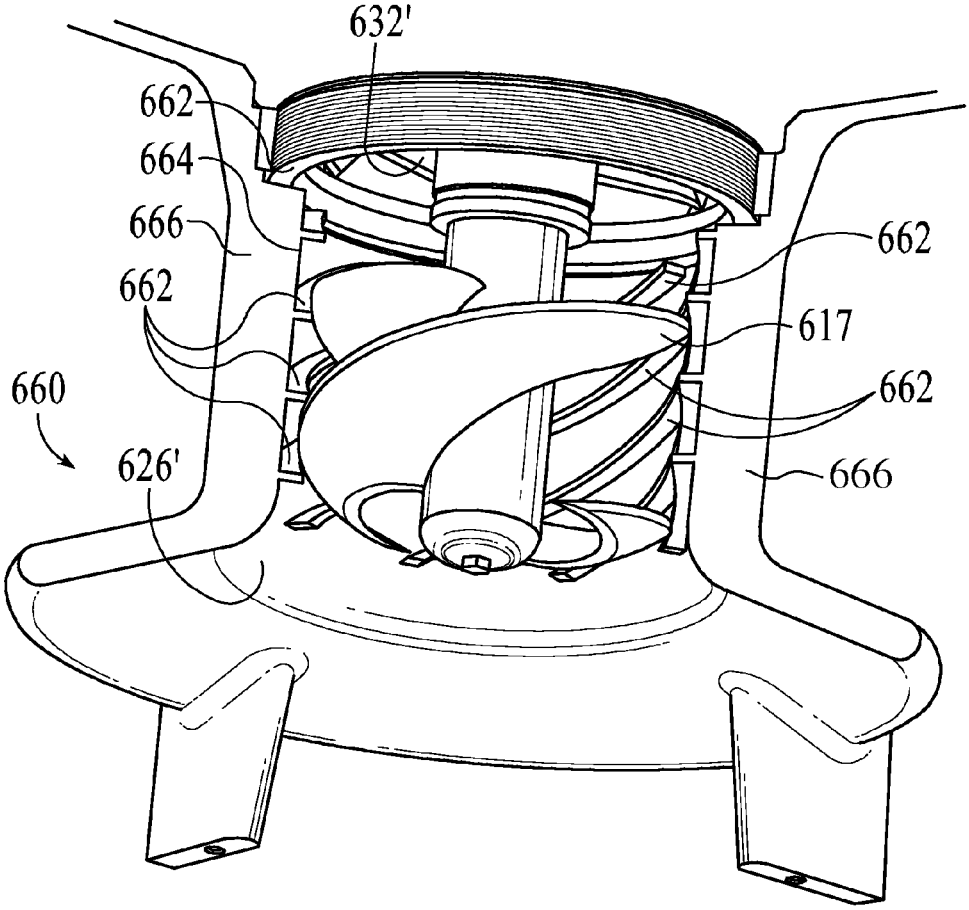
FIG. 6B is a representative partially broken, cross-sectional perspective, lower side view of an embodiment of a curved blade, increasing slope, helicoid plane surface, vaned housing inducer rotor of the present invention.

FIG. 6B is a representative partially broken, cross-sectional perspective, lower side view of an embodiment of an increasing slope, helicoid curved plane surface 100', vaned housing inducer rotor assembly 660 of the present invention. The inducer assembly 660 of FIG. 6B is also similar to the inducer assembly 610 best shown in FIG. 6A, but has one or more vanes 662 formed in the interior wall 664 of the exterior housing 666 in place of the grooves 624. Like the grooves 624 discussed above, the vanes 662 are helical structures which project outwardly from the inside wall 664 of the induce housing 666 and that spiral in a second direction, i.e., one that is counter-rotational to the first direction of the curved blades 617, with the curved blades 617 and the vanes 662 having optionally matching but reverse, concentric, spirals. The vanes 662 do not extend into the transition area 626', but do extend all of the way or substantially all of the way to the outlet 632'. The vanes 662, like the grooves 624 of best shown in FIG. 6A, capture and guide fluid that is rotating with the curved blades 617, by pushing the fluid into the gaps formed between the vanes 662, and move the fluid to the outlet 632'. The depth and width of the vanes 662 need to be sufficient to be durable and need to form a substantially tight relationship with the curved blades 617 so that fluid cannot readily escape between the vanes 662 and the curved blades 617. The height and width of the vanes 662 will depend on the fluid being moved and the particular application of the inducer rotor assembly 660 of FIG. 6B.

It will be understood that while shown as representational only, the vanes 662 spiraling upward in a counter-rotational direction compared with the impeller blades 617 can be any type of extruded or extending projections attached to the inner wall portion 664 of the inducer housing 666 having a rectangular, square, round or formed cross section and projection profile. The vanes 662 can be narrow and short or longer and fin-like or broad and flat. In addition, the vanes 662 themselves can have a flat contour, sloped contour or curved, parabolic curvature such as provided in the angled and curved impeller blades of the present invention.

The grooves and/or vanes counter-rotation inducer housings used in conjunction with the angled and curved impeller blades described herein are further described and detailed in U.S. patent application Ser. No. 12/701,453 filed Feb. 5, 2010 entitled COUNTER ROTATION INDUCER HOUSING, which claims benefits of U.S. Provisional Application No. 61/273,376 filed Aug. 3, 2009 entitled COUNTER ROTATION INDUCER HOUSING, which is incorporated herein by reference in its entirety, and claims any and all benefits to which it s entitled therefrom.

Figure 6C:
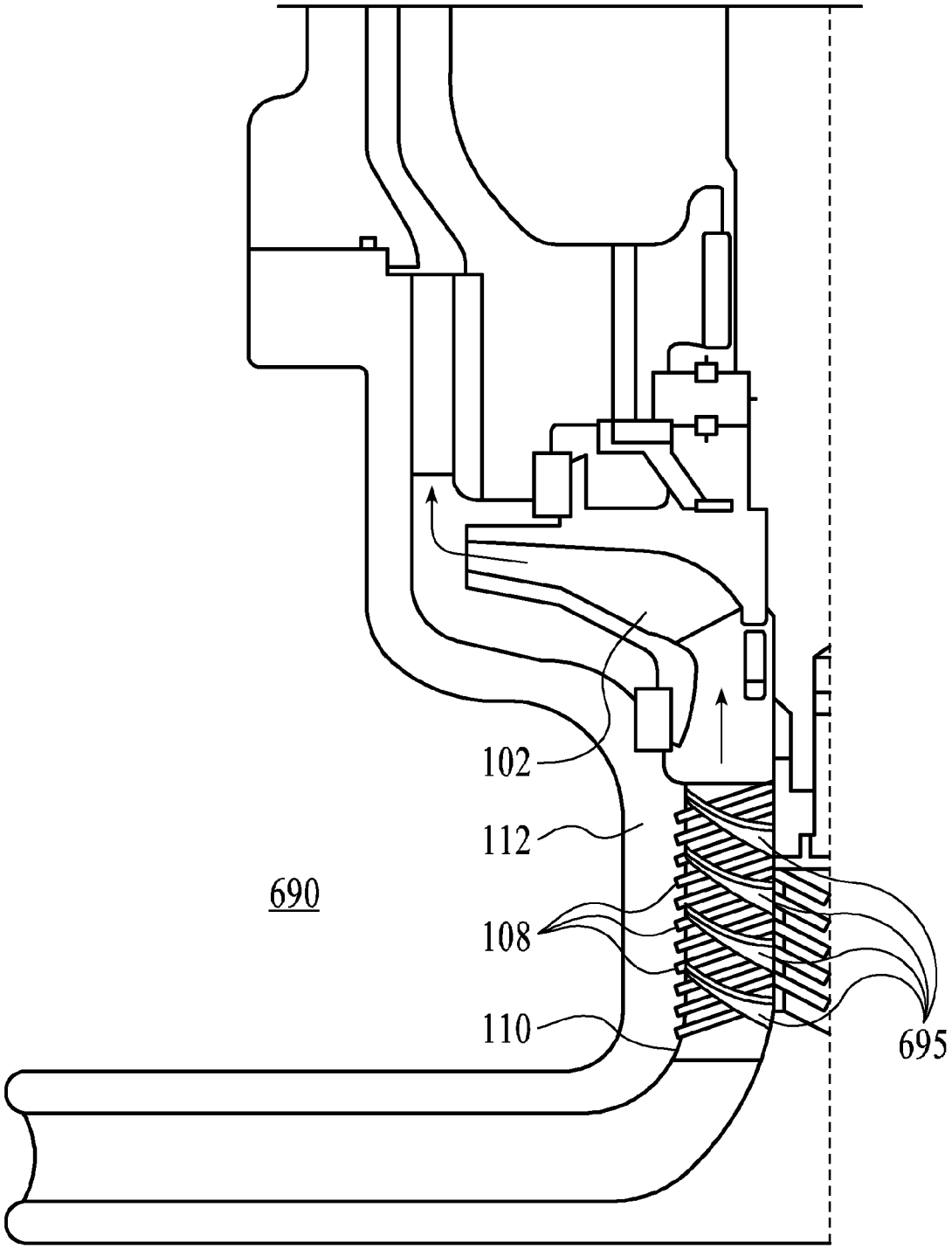
FIG. 6C is a representative partially broken, cross-sectional, side view of an embodiment of a curved blade, increasing slope, helicoid plane surface, multi-stage, grooved or vaned housing inducer rotor of the present invention.

FIG. 6C is a representative partially broken, cross-sectional, side view of an embodiment of an increasing slope, helicoid plane surface, multi-stage, grooved housing inducer rotor 690 of the present invention. One or more grooves 108 are added to the interior wall 110 of the exterior housing 112, to further capture and guide fluid through the inducer 690 into the impeller 102. The inducer has multiple stages 695 of rotating blades and fixed vanes. Many additional combinations of and variations to the grooves and vanes of the inducers illustrated above are possible and are contemplated by this disclosure.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. An inducer for upward vertical flow, cryogenic liquid centrifugal pumps comprising:

a stationary outer housing portion having an inlet and an outlet, the inlet located at a lower end and the outlet located at an upper end, the housing further having an inner wall portion with one or more spiral vanes projecting outwardly from the inner wall portion, the one or more spiral vanes defining one or more gaps on the inner wall portion that spiral in a first direction; and an inner rotating impeller mounted on a rotating center shaft, the shaft having a uniform diameter along its length, the impeller having at least one curved blade which defines a parabolic, curved, helicoid plane surface having the rotating center shaft as a center axis, in which the radial slope of the parabolic helicoid plane increases as the distance from the center axis increases, the parabolic curved blade further having the parabolic curvature continually throughout the entire blade, the impeller rotating in a second direction which is in counter rotation to the first direction, whereby a substantially tight relationship between the outwardly extending one or more vanes on the inner wall portion and the curved blade confine the cryogenic liquid to the one or more gaps and move liquid toward the housing outlet.

2. The inducer of claim 1 in which the one or more spiral vanes have a flat contour.

3. The inducer of claim 1 in which the one or more spiral vanes have a sloped contour.

4. The inducer of claim 1 in which the one or more spiral vanes have a parabolic curvature.

5. A multistage inducer for upward vertical flow, cryogenic liquid centrifugal pumps comprising:

a multistage stationary outer housing portion having an inlet and an outlet, the inlet located at a lower end and the outlet located at an upper end, each stage of the multistage housing further having an inner wall portion with one or more spiral vanes projecting outwardly from the inner wall portion, the one or more spiral vanes defining one or more gaps on the inner wall portion that spiral in a first direction; and a separate, inner rotating impeller corresponding with each stage of the multistage housing with each impeller mounted on a single, axial, rotating center shaft, the shaft having a uniform diameter along its length, each impeller having at least one parabolic curved blade which defines a parabolic curved, helicoid plane surface having the rotating center shaft as a center axis, in which the radial slope of the parabolic curved helicoid plane increases as the distance from the center axis increases, the parabolic curved blade further having the same parabolic curvature continually throughout the entire blade, each impeller rotating in a second direction which is in counter rotation to the first direction, whereby a substantially tight relationship between the outwardly extending one or more spiral vanes on the inner wall portions and the curved blades confine the cryogenic liquid to the one or more gaps and move liquid toward the housing outlet.

6. The inducer of claim 5 in which the one or more spiral vanes have a flat contour.

7. The inducer of claim 5 in which the one or more spiral vanes have a sloped contour.

8. The inducer of claim 5 in which the one or more spiral vanes have a parabolic curvature.

* * * * *